US010118068B2

(12) United States Patent
Trivković et al.

(10) Patent No.: US 10,118,068 B2
(45) Date of Patent: Nov. 6, 2018

(54) EXERCISE MACHINE WITH LOAD ROLLING SIMULATION

(71) Applicant: SISYPHUS FITNESS INC., Clermont, FL (US)

(72) Inventors: Vuk Trivković, Belgrade (RS); Relja Trivković, Belgrade (RS)

(73) Assignee: SISYPHUS FITNESS INC., Clermont, FL (US)

( * ) Notice: Subject to any disclaimer, the term of this patent is extended or adjusted under 35 U.S.C. 154(b) by 24 days.

(21) Appl. No.: 15/312,738

(22) PCT Filed: May 26, 2015

(86) PCT No.: PCT/RS2015/000013
§ 371 (c)(1),
(2) Date: Nov. 21, 2016

(87) PCT Pub. No.: WO2015/183119
PCT Pub. Date: Dec. 3, 2015

(65) Prior Publication Data

US 2017/0182355 A1 Jun. 29, 2017

(30) Foreign Application Priority Data

May 26, 2014 (RS) ..... 2014/0265

(51) Int. Cl.
*A63B 22/00* (2006.01)
*A63B 21/005* (2006.01)
(Continued)

(52) U.S. Cl.
CPC ..... *A63B 22/001* (2013.01); *A63B 21/005* (2013.01); *A63B 21/154* (2013.01);
(Continued)

(58) Field of Classification Search
None
See application file for complete search history.

(56) References Cited

U.S. PATENT DOCUMENTS 4,555,108 A * 11/1985 Monteiro ..... A63B 22/04 482/112
4,842,269 A * 6/1989 Huang ..... A63B 22/0002 482/115
(Continued)

FOREIGN PATENT DOCUMENTS

CN 201426939 Y 3/2010
CN 203060676 U 7/2013
(Continued)

OTHER PUBLICATIONS

International Search Report for PCT/RS20015/000013 filed May 26, 2015; 4 pages.
(Continued)

*Primary Examiner* — Stephen R Crow
(74) *Attorney, Agent, or Firm* — Hoffman Warnick LLC

(57) ABSTRACT

Exercise machine with load rolling simulation substitutes training in the open air in which a load is rolled or pushed. The exercise machine comprises a continuous moving track (2) of adjustable incline. Above the housing (1) and in front of the continuous moving track (2) is mounted a wheel (4) with paddles (5). The paddles (5) on the outer circumference of the wheel (4) are performed in the shape of teeth, ribs, panels or bars. The wheel (4) is connected by a transmission (20) with the track (2). The track (2) is connected with the brake system (32) for change of resistance to motion of the track (2), and thereby also to turning of the wheel (4). The control panel (6) with display contains commands for adjusting and monitoring the inclination of the track (2) and the resistance to turning of the wheel (4) and for monitoring the velocity and travelled distance of the moving track (2), as
(Continued)

well as the duration of the training on the continuous track (2). The exercise machine is used in at least three ways of exercising, it has exceptional ergonomic characteristics, and enables safe training.

9 Claims, 7 Drawing Sheets

(51) Int. Cl.

| | |
|---|---|
| ***A63B 21/22*** | (2006.01) |
| ***A63B 21/00*** | (2006.01) |
| ***A63B 22/02*** | (2006.01) |
| ***A63B 23/04*** | (2006.01) |
| ***A63B 24/00*** | (2006.01) |
| ***A63B 71/06*** | (2006.01) |
| ***A63B 23/035*** | (2006.01) |

(52) U.S. Cl.
CPC ..... *A63B 21/22* (2013.01); *A63B 22/0023* (2013.01); *A63B 22/0235* (2013.01); *A63B 23/03575* (2013.01); *A63B 23/047* (2013.01); *A63B 24/0087* (2013.01); *A63B 71/0619* (2013.01)

(56) References Cited

U.S. PATENT DOCUMENTS

| | | | | |
|---|---|---|---|---|
| 5,145,475 | A | 9/1992 | Cares | |
| 6,217,487 | B1 | 4/2001 | Reinert | |
| 6,824,501 | B2 * | 11/2004 | Kuo | A63B 22/0235 482/52 |
| 7,727,118 | B1 * | 6/2010 | McCall | A63B 69/0048 482/112 |
| 8,702,571 | B2 * | 4/2014 | Fenster | A63B 22/04 482/52 |
| 9,789,355 | B1 * | 10/2017 | Lo | A63B 22/04 |
| 2008/0300110 | A1 | 12/2008 | Smith et al. | |
| 2011/0042957 | A1 * | 2/2011 | Drews | F03B 7/003 290/54 |

FOREIGN PATENT DOCUMENTS

| | | | |
|---|---|---|---|
| EP | 2055356 | A1 | 5/2009 |
| WO | 99/52601 | | 10/1999 |
| WO | 2007/058859 | A2 | 5/2007 |

OTHER PUBLICATIONS

Written Opinion of the International Searching Authority for PCT/RS20015/000013 filed May 26, 2016; 6 pages.

* cited by examiner

EXERCISE MACHINE WITH LOAD ROLLING SIMULATION

FIELD OF THE INVENTION

The invention falls into the category of exercise machines used in sports training centers and gyms. It can more closely be classified into the category of machines with moving tracks, which can be horizontal or under an adjustable incline, for walking or running with additional elements for training certain target groups of muscles while walking or running on the track, and especially for a specific training which simulates rolling or pushing a load on a flat surface or slope. On the basis of the construction, according to the International Classification of patents, the machine is classified as an exercise machine especially suitable for strengthening the cardiovascular system, exercising suppleness or coordination of movement with moving continuous track and is designated by the classification symbol A 63 B 22/02. One embodiment of the invention, as will be described in detail in continuation, may be classified, according to the International classification of patents, into the category of gymnasium equipment for developing or strengthening muscles or joints by overcoming resistance with measuring instruments and with the use of a resistor and use of rotational elements and is designated by the classification symbol A 63 B 21/015. On the basis of the purpose, according to the International classification of patents, the invention may also be classified in the category of exercise machines especially adapted for certain parts of the body, i.e. for the stomach, spine or shoulders, (which corresponds to the classification symbol A 63 B 23/02) and for the upper and lower extremities simultaneously (which corresponds to the classification symbol A 63 B 23/035).

TECHNICAL PROBLEM

The technical problem to be resolved by this invention arises from the following facts. Sports professionals and sportists have been aware for a long time of the positive effects to be obtained by training which corresponds to rolling or pushing of a load on a flat surface or slope. In order to achieve these effects, training in the open air is practiced, i.e. on a natural slope with pushing or rolling of improvised objects (e.g. tractor tyres, a loaded barrel or an automobile). In addition to the positive effects and benefits to the sportist, such training has a whole series of shortcomings. The training can be performed only in a certain location and a larger surface, so it's very hard to find a natural terrain that corresponds to these needs. The training is performed in the open air so that sportists are exposed to unfavourable weather conditions during training, e.g. rain or excessive heat. At the same time, there is the problem of monitoring the training and the sportist's progress, as well as recording the results with modern methods, i.e. the problem of measuring the sportist's speed and measuring the rolled load, as well as recordal, i.e. memorization of the achieved results. The next problem that is very difficult to resolve when rolling improvised objects on a flat surface or slope is the very complicated adjustment of the load during rolling of the load, and this problem can be resolved only by replacing the improvised objects that are rolled. From the above, it is quite clear that an exercise machine for gymnasium use that would simulate rolling or pushing of a load on a flat surface or slope would enable training that achieves the positive effects of this kind of exercise, while avoiding all of the aforementioned shortcomings, in other words, it would enable training in a small area, in the closed and protected environment of a gymnasium, with the possibility of monitoring and recording the results achieved by the sportists and the possibility of adjusting the load. The technical problem can also be defined in the following manner: how to construct a exercise machine with simulation of pushing a load on a flat surface or slope with the simultaneous possibility of monitoring the training parameters, primarily the speed of walking or running of the sportist, distance travelled, and load, with the possibility of adjusting the load.

STATE OF THE ART

On the exercise machine or fitness machine market, there are different machines with moving tracks which include systems for monitoring training parameters, primarily the velocity of the track and duration, recordal of the measurements on the correponding indicator, usually a display, as well as equipment for adjusting track speed. Such machines are widespread and known to a wide circle of users. There also exist machines with moving tracks and devices for simultaneous exercising of the arms. The most frequent machines on the market are those with various types of levers. These machines can be divided into two groups: machines with track drives, e.g. electromotor and tracks driven by armwork of the user. However, there are no machines on the market that simulate pushing a load on a flat surface or slope.

Searching the Serbian fund of patent documents, the closest found document was the publication of patent application P-2008/0219 for an invention entitled: Transporter for running. This document describes a continuous track for running, which has the possibility of adjustment of incline with the aid of coil equipment and elastic support constructed by use of a coil which supports one side of the frame with cylindric bearings, between which the continuous track is taughtened. The characteristic of this invention is also the non-existance of a drive device, i.e. electromotor for adjusting the incline of the track. Without detailed citation of the shortcomings of the offered solution, the difference in construction between the state of the art and the machine from the subject application is obvious, since the machine described in the state of the art does not contain any elements for activation of the arms in the course of the training.

Searching the foreign collections of patent documentation, the closest state of the art were the following documents: EP 0877 640 B1, U.S. Pat. No. 8,172,729 B2 and WO 99/52601. It can be considered that these documents represent different solutions from the same technical area, and in continuation are cited the differences in respect to the subject invention.

In the letters patent of EP 0 877 640 B1, a machine under the following name is described: Track for running with manual drive. The cited document describes a track for running under an adjustable mild incline in respect of the base, set on two cylinders. Basically, vertically in respect of the base, two levers are positioned which the user moves back and forth with his arms while running. The levers are connected with a corresponding transmission mechanism to the drive cylinder of the continuous track and by moving the levers, through the transmission mechanism, the track is driven, by conversion of the alternate, basically rectilinear motion of the arms, through the transmission mechanism, into circular motion of the drive cylinder. In this way, according to the citations in the document, training of the upper and lower part of the body is performed, as the track is moved by armpower. In order to increase the arm load as needed, a friction brake system for the drive cylinder of the continuous track is provided, which may be operated by motor. There is a number of differences between the machine cited in the state of the art and the machine from the subject invention, the most obvious being the difference in the construction of the part of the machine for activation of the arms and the group of muscles in the upper body, i.e. the difference between the levers with alternate rectilinear motion and paddle wheel with circular motion, according to the subject invention. The purpose of the state of the art machine is different from the purpose of the machine according to the subject invention, as it does not achieve simulation of rolling or pushing of a load, which is the goal of the subject invention.

In the patent document U.S. Pat. No. 8,172,729 B2, a moving exercise track with simulation of pushing and pulling of a load is desribed. The machine has several embodiments, and basically comprises a moving track set on two cylinders, which can move in two directions, and which has on its frontal part a console on which are placed, at the level of the upper body, one lever for both hands, or two levers, for the left and right hand. During the movement of the user on the track, pusing and pulling of the levers is enabled, where the strength necessary for pushing and pulling of the levers can be adjusted. This machine also provides for a track drive, transmission, and known equipment for adjusting the velocity and direction of movement of the track, monitoring track velocity, recording achieved results, etc. Different embodiments of this invention provide for simultaneous pushing and pulling of the load by use of both arms (one lever) or alternate use of each arm (two levers). The movement of the arms is basically back and front. This state of the art invention differs from the subject invention in the construction of the elements for the armwork, i.e. for training the target groups of muscles of the arms, back, shoulder area and stomach, in that these elements in the state of the art invention comprise one or two horizontal levers placed transversally in respect of the continuous track, whereas the construction designed for the activation of the arms in the subject invention is a paddle wheel. The machine according to the subject invention does not provide for a motor for driving the track, whereas the state of the art machine has a motor for driving the track. The obvious difference between these two machines is also that the state of the art invention provides for completely different arm movements and muscle exercise as compared to the subject invention.

In patent document WO 99/52601, a machine is described for pushing and pulling exercises. The machine has a special indented continuous track with a surface specially secured to prevent slipping of the user's footwear. Several variants of indentations i.e. wedges for the track are provided for. On the frontal part of the machine, transversally in respect to the continuous track, is a bar for supporting the user. The bar is immobile, i.e. static, and during the exercises, the user supports himself by holding on to the bar, while moving the track with his legs. Movement of the track is obstructed by a brake system which includes an electromotor and a braking mechanism. In addition to the frontal bar, other embodiments of this invention provide also for one or two longitudinal bars, as well as a bar at the back, to which belts are fastened, which are affixed over the shoulders and chest of the user in another way of exercising. Here also is provided a device for monitoring the achieved results, i.e. speed of movement of the track and duration of movement, as well as the possibility of adjusting the track braking force. The difference between the state of the art machine and the subject invention is that the state of the art machine has a special indented track, while the machine according to the invention has a track that is usually used in this technical area, and in that the element for the armwork is stationary and constructed in the form of a bar, while in the machine according to the invention, the element for the armwork is constructed in the form of a moving, i.e. revolving paddle wheel. The obvious difference between these two machines is also in the fact that the state of the art invention does not simulate rolling of a load, but instead, the user is supported by a bar or belts while moving the track, so the training on these two machines is different.

SUMMARY OF THE INVENTION

The exercise machine with simulation of load rolling was designed because of a need for a type of training that corresponds to rolling or pushing a load, with simultaneous moving or running on a flat surface or slope. Sports experts and sportists are familiar with the effects of exercise achieved by rolling or pushing a load and simultaneous moving. So far, a machine that would enable this type of exercise in a sheltered space and a small surface has not existed on the market. As can be seen from the above state of the art, existing patent documentation also does not reveal a machine which would entirely fulfill the need for this kind of exercise in an optimal way. Even though this kind of exercise is intended primaly for sportists, it can be applied to recreational exercising or in physical therapy.

Like some of the machines cited in the state of the art, the exercise machine with load rolling simulation has a continuous track for running or walking with adjustable incline. The incline of the continuous track can be adjusted from flat ("zero incline"), through an incline corresponding to a mild slope, to a specified marginal incline corresponding to a steeper slope. The construction of the continuous track corresponds to that of some of the tracks cited in the state of the art. The continuous track for walking or running is placed on two cylinders, one of which is the drive cylinder. It is convenient for the drive cylinder to be front or upper cylinder located in the housing. Both cylinders are fixed with bearings to the supporting structure. The supporting structure of the entire machine can be a welded construction of steel profiles. The drive cylinder is connected through a transmission with the wheel, and the track is driven by rolling of the wheel. The transmission can be, for example, a gear transmission, belt drive transmission, chain driven transmission or combined transmission, but does not exclude other types of transmission. In one preferable embodiment of the invention, the transmission is combined, i.e. chain driven transmission with two chain couplings and one gear coupling, and the driven gear of the gear coupling is located at the end of the drive cylinder of the track. The transmission ratio of the transmission can vary, and in one primary embodiment, the peripheral velocity of a point on the rim of the wheel is equal to the speed of the continuous track, so therefore the distance travelled on the track may approximately correspond to the distance travelled by a point on the rim of the wheel. The transmission is constructed in a way know in the technical field, and some elements of the transmission may be standard elements that can be purchased on the market. The transmission is connected in a known way to a control panel with a display, thereby allowing the user to monitor the velocity of the track and the distance travelled. The transmission is located in ahousing behind the masks of the supporting structure. The supporting structure of the track is covered by suitable masks for safety and the aesthetic appearance of the machine. For example, the masks may be made out of metal sheet and/or plastic. In the front part, the continuous track enters the housing, in which is located the front or upper cylinder. The front or upper cylinder of the continuous track may be connected at one end with the brake system known in the technical field. The function of the brake system is to increase resistance to the motion of the drive cylinder of the track, and thereby also to the pushing of the paddles, i.e. rolling of the wheel, since the cylinder is driven by the wheel. In one of the prefered embodiments, on one side of the front cylinder is located a pulley, connected by a belt with another pulley, on the shaft of which is located a flywheel connected with the electromagnetic braking device. Such brake system is known in the technical field, it is connected with a control panel with display and the intensity of braking can be controlled from the control panel.

Adjustment of the incline of the track is performed in a known way, for example, with the aid of a coil mechanism: a screw or threaded spindle and screw nut, so that the front leg of the machine, which can be rotated in respect of the supporting structure, is connected with the screw. Another preferable way for practicing the mechanism for adjusting the incline could be a gear coupling: gear and rack. Adjustment of the incline of the exercise machine can be performed through the drive, which can be operated through the control panel, as is already known in the state of the art. In one primary embodiment, the drive is an electromotor, the threaded spindle is connected with the drive and the motion of the threaded spindle causes motion of the screw in the direction of the axle of the threaded spindle, which is in a vertical position. In this way the moving track is lowered or raised and its incline is adjusted. On both lateral sides of the moving track, masks are constructed. The upper surface of the masks is made of materials that prevent slippage of the user's footwear, and the user can stand on the lateral masks in one of the possible ways of exercising on the machine.

As opposed to continuous tracks with different elements for exercising the arms (usually levers), which are known in the state of the art, the exercise machine with simulation of load rolling or pushing comprises a paddle wheel in the front part of the continuous track. The construction, position and shape of the wheel are features that differentiate the exercise machine according to the invention from the state of the art. State of the art exercise machines which have various levers for simultaneous exercising and movement on the track do not provide the same result and do not exercise the same groups of muscles as the machine according to the invention, where turning the wheel under a specified load with simultaneous movement on the track provides the desired effect which corresponds to the effect of rolling or pushing a load in an open space. The terms rolling and pushing are used here in the following sense: in rolling, the entire wheel is turned, while in pushing, only specific paddles are moved, and since either rolling or pushing the paddles results in turning or rolling of the wheel, these terms are interchangeable in the context of this description. The height of the axis of rotation and circumpherence of the wheel can be varied within a specified range in various embodiments of the invention, but they are adapted to the height and arm length of an adult person. The shape of the paddles may differ, i.e. the paddles may be flat, in the form of panels of various shapes, they may be in the form of curving bars, in the form of ribs or wedges of various shape, or they may be differently profiled teeth. In one preferred embodiment of the invention, shown in the drawings, the paddles are in the shape of teeth whose cross section is reminescent of a right angled triangle with curvilinear sides and a rounded vertex. These paddles correspond to the shape and movements of the hand so it may be considered that they have good ergonomic characteristics. The paddles may be performed by casting in plastic and may be manufactured in one part, or comprised of several assembled segments. In the illustrative embodiment, the paddles are manufactured from several segments. The wheel has an axis with rotational bearings on legs which form part of the supporting structure of the fitness machine. The legs are at an approximately right angle in respect of the track surface. The wheel may be performed in various ways, e.g. in the form of a drum, or as in the example shown in the drawings, as a wheel with rim and spokes. The axis of the wheel is connected by the transmission to the continuous moving track and turning of the wheel drives the continuous moving track. The transmission can be performed in a variety of known ways. In one preferred embodiment, the transmission is a combined chain driven gear transmission, as already described. The bearings of the wheel and transmission are located behind appropriate masks for aesthetical and safety reasons and cannot be seen in the drawings.

A brake system for adjustment of the wheel turning resistance force and device for adjusting track inclination and corresponding electronic devices are already known in the technical field and are located inside the housing. They are connected in a known manner with the control panel with display located in the outer part of the housing towards the moving track, within the field of view of the user and easily accessible to the user. The housing itself is located in the front part of the continuous track, underneath the paddle wheel. With one part, the housing also encloses the front upper part of the continuous track. The housing is provided for safety and aesthetic reasons and can be performed from metal sheet, plastic or any other suitable material.

The control panel with display located on the outside of the housing, on the side turned towards the continuous moving track, enables managing the operation of the device and monitoring the exercize parameters. The control panel primarily enables adjustment of track inclination, regulation of the wheel turning resistance force and monitoring of track velocity, travelled distance on the track, load, and exercise duration, with showing of these parameters on a display. The control panel is an electronic device and devices of this type are known in the state of the art.

Between the supporting structure and the base, supporting legs are provided for. In the embodiment of the invention shown in the drawings, a couple of legs are located on the back, lower part of the track and these are the back legs. The front legs are located under the housing and may be performed as constructions made from bars, where one part is rotated in respect of the supporting structure of the exersize machine, and they represent the part of the device for adjusting track inclination. The device for adjusting track inclination can be performed as a device with threaded connection driven by motor, as known in the state of the art. The front and back legs may have wheels which facilitate relocating the machine inside the gymnasium.

The exercise machine in accordance with the invention may be applied in three ways, in other words, there are three possible ways to exercise on the machine. The first way of exercising, as known from the state of the art, is walking or running on a horizontal track or inclined track without turning the paddle wheel. When the track is inclined, the user moves the track with the weight of his body during exercising and at the same time the track is turned, even though the user does not activate it with his arms. The second way of exercising is walking or running on the horizontal or inclined track with turning of the wheel. In that case, the track is driven by the synchronized motion of the arms and legs, since movement of the track is facilitated by the legs. The third way of exercising is simply turning the track while the user stands still. The track itself will be moved by turning of the wheel, and the user will stand on the lateral track masks, on surfaces protected from slippage.

The most important advantage of the invention is that it enables training performed in the open air by rolling or pushing of a load, usually an improvised one, to be replaced by a specialized exercise machine of high technology which has the possibility of adjustment of exercise parameters and monitoring of results. In this way exercising is transferred from the open air into a gymnasium, i.e. to a small area, which allows for protection from unfavourable meteorological conditions, i.e. precipitation, cold and heat. By adjusting the angle of the continuous track and wheel turning resistance, the exercise parameters can be combined, and the achieved results, primarily the duration of the training, can be easily measured and monitored. The exercise machine according to the invention completely replaces the need for training with rolling or pushing of a load in the open air. By combining the exercise parameters, optimal loads for each individual user can be chosen, and then they can be modified in accordance with the user's progress. In this way, the circle of users who can train in this manner is broadened, as the training can range from relatively easy to very hard training. With the appropriate housing, paddle shape and masks, a very high safety level for the user is achieved, and there is no possibility of injuries which would result from the construction of the exercise machine according to the invention. The machine can easily be relocated inside the gymnasium thanks to the casters on the legs.

The parts of the machine are constructed from known materials and with a known technology so that preparation for production is relatively simple. Certain parts of the machine, i.e. electromotor, electronic devices, transmission elements, elements of the braking device, can be obtained on the market.

BRIEF DESCRIPTION OF THE DRAWINGS OF THE INVENTION

The exercise machine with simulation of load rolling in accordance with the invention is shown on the following drawings. The drawings represent a depiction of one embodiment of the invention and they do not limit the scope of protection defined by the patent claims. The drawings do not depict some elements and constructions which the expert in the corresponding technical field may perform in a manner generally known in the technical field. The drawings depict the following.

The invention is described below in detail, with reference to the above drawings.

DETAILED DESCRIPTION OF THE INVENTION

Figure 1:
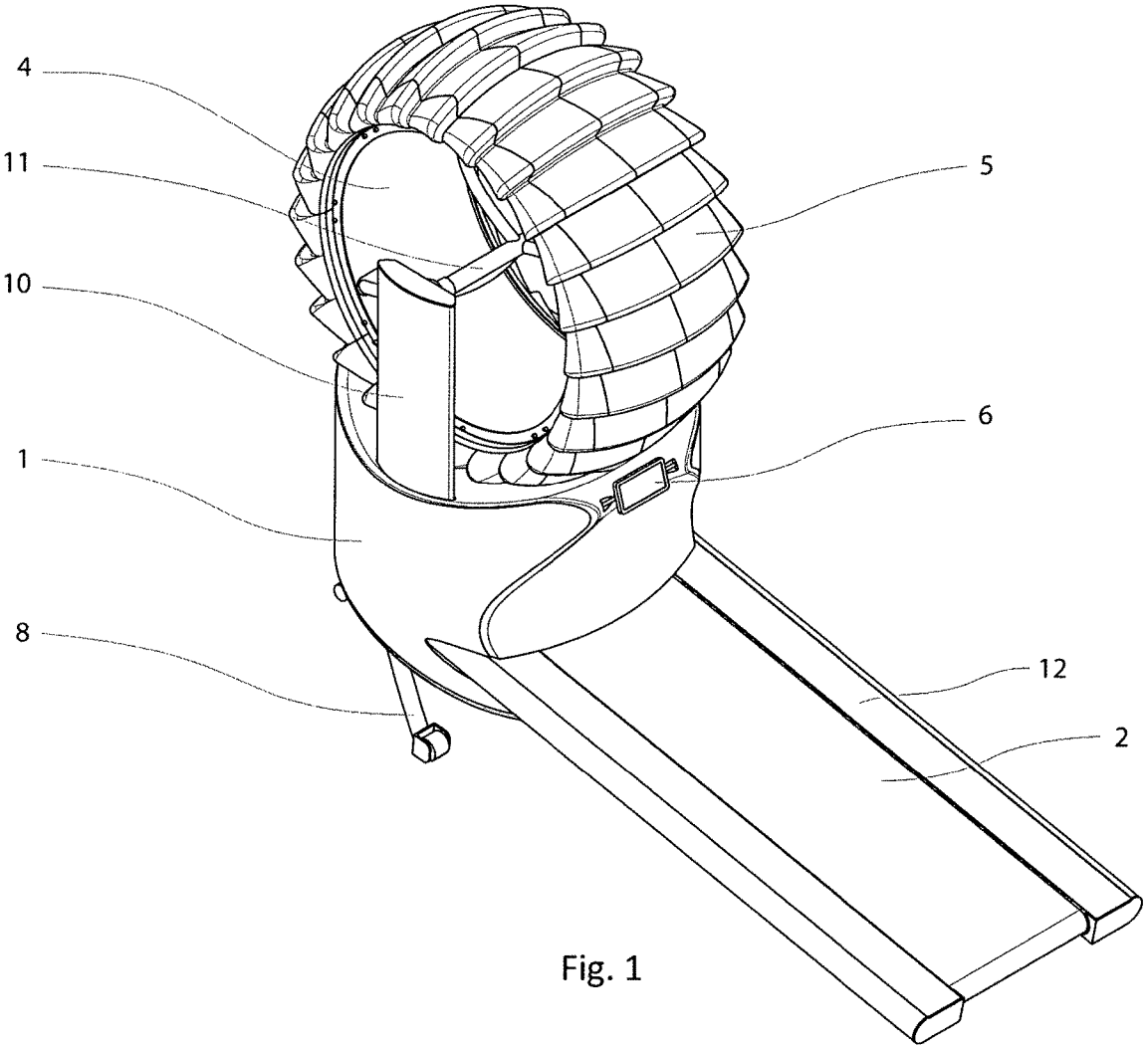
FIG. 1 depicts in isometry the exercise machine with simulation of load rolling in accordance with the invention.

FIG. 1 depicts in isometry one embodiment of the exercise machine with load rolling simulation. The exercise machine has a continuous moving track 2 the incline of which can be adjusted. Adjustment of the moving track 2 ranges from flat position (zero incline) over a position corresponding to a mild uphill slope to a position corresponding to a steeper uphill slope. The front, higher end of the continuous track is located in the housing 1. The continuous moving track 2 is placed on two rotating cylinders 21, one of which is a drive cylinder 21. It is preferable for drive cylinder 21 to be the front, higher cylinder 21. The cylinders 21 are mounted in the supporting structure of the machine, which is covered for safety and aesthetical reasons by lateral masks 12 located along both longitudinal sides of the continuous track 2, housing 1 and masks 10 of the supporting structure. The drive cylinder 21 is, with the aid of the transmission 20, primarily the combined chain gear, connected with the wheel 4 with paddles 5. The transmission 20 is also connected with the control panel 6 with display of electronic elements. In one preferred embodiment at one end of the drive cylinder 21 of the track 2 is located the driven gear wheel 29 which together with the pinion 28 comprises the gear coupling. The gear coupling is connected, via two chain couplings, with the shaft 11 of the wheel 4. The first, drive sprocket 23 of the first chain coupling is mounted on the shaft 11 of the wheel 4. This chain coupling can also have a sprocket 25 for adjusting the taughtness of the chain. The driven sprocket 24 is on the same shaft as the driven sprocket 26 of the next chain coupling. The driven sprocket 27 of the second chain coupling is on the same shaft as the drive gear wheel 28 of the gear coupling, while the driven gear wheel 29 is firmly connected to the front cylinder 21 on which the track 2 is mounted. The track 2 itself is constructed of known materials, used in this technical field, and the transmission 20 and drive of the track 2 via the wheel 4 are performed in any of the ways known in the technical field and can be comprised of elements that are available on the market. The transmission ratio of the transmission 20 and circumference of the wheel 4 can be adjusted so that the peripheral velocity of a point on the rim of the wheel 4 is approximately equal to the speed of the continuous track 2 or in other words, so that the travelled distance of the point on the rim of the wheel 4 corresponds to the travelled distance of a point on the continuous track 2. This transmission ratio and circumference of the wheel 4 contribute to better simulation of rolling of a load in the open air when the user travels the same distance as a point on the circumference of the rolled object. The transmission 20 i.e. drive of the track 2 is with the help of the wheel 4 located in the housing 1 and behind the mask 10 of the support. The exercise machine according to the invention also has a brake system32 for adjusting the resistance to turning of the wheel 4. Different braking devices known from the technical field can be used, i.e. friction, electromagnetic, and other and they are connected with the control panel 6 with display. In one proffered embodiment of the invention, on the other end of the drive cylinder 21 of the track 2 is located a pulley 30 which together with the pulley 31 comprises the belt couple of the brake system 32, e,g. mechanical brake system 32 with electromotor, which is connected to the control panel 6. Activation of this system 32 leads to braking of the drive cylinders 21 of the track 2 and this obstructs the turning of the wheel 4 which drives the track 2. The lateral masks 12 of the track 2 are flat on top, as depicted on the drawings, and their top surfaces are protected against slippage of the user's footwear during one of the ways of exercising on the machine according to the invention.

Figure 5:
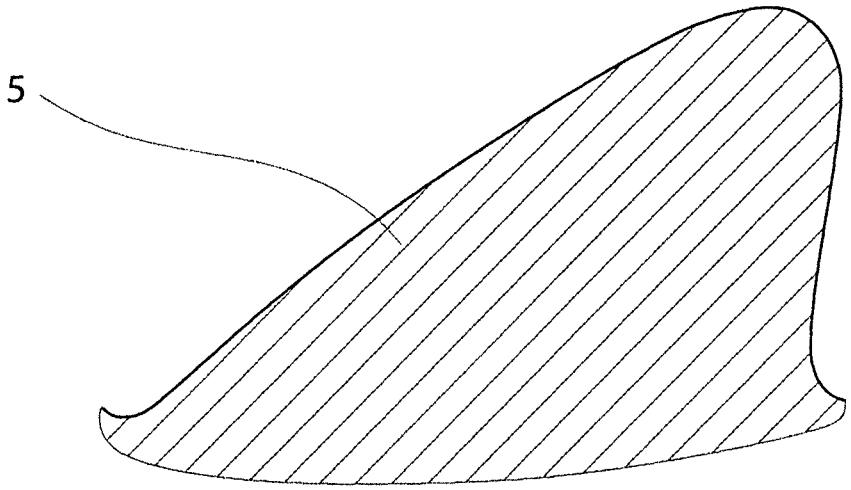
FIG. 5 depicts in cross section one embodiment of the paddle of the exercise machine with simulation of load rolling in accordance with the invention.
Figure 6:
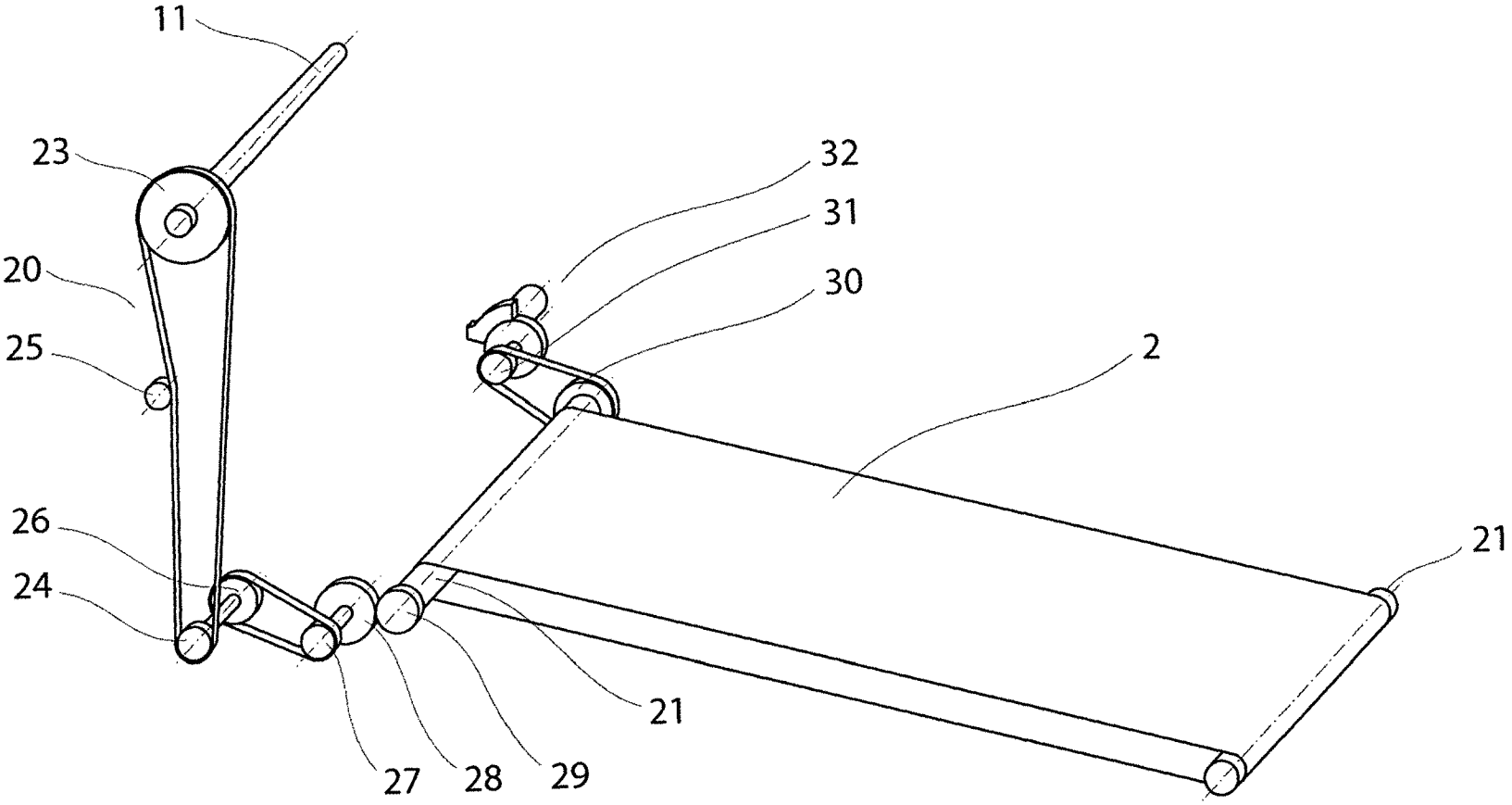
FIG. 6 depicts in a simplified manner, schematically, in oblique projection, the transmission between the wheel shaft and the moving track and the brake system of the exercise machine with simulation of load rolling in accordance with the invention.

Above the housing 1 on two supports is pivotally mounted the wheel 4. In this example, the wheel 4 is performed as a wheel 4 with rim and spokes. In other embodiments of the invention, not shown on the drawings, the wheel 4 can be performed as a drum or in another preferred way. The shaft 11 of the wheel 4 is on both sides mounted on the supports, which represent a part of the supporting structure of the exercise machine and are not shown on the images, as they are located for safety and aesthetical reasons behind the mask 10 of the support. On one end of the shaft 11 of the wheel 4 is located a sprocket 23 of the transmission 20 for the drive of the track 2. Along the outer circumference of the wheel 4 are performed the paddles 5. In the shown embodiment, the paddles 5 are performed in the shape of teeth whose cross section corresponds to a three-sided geometrical image with curvilinear sides and at least one rounded vertex, as shown in FIG. 5. The paddles 5 in the shown example of the embodiment are constructed of several segments. Roughly speaking, the cross section of the paddles 5 in the shape of teeth is reminescent of a right angled triangle whose smaller cathetus is turned towards the user who by pushing it, rolls the wheel 4, thereby achieving simulation of outdoor exercise by pushing or rolling a load. This shape of paddle 5 has excellent ergonomic characteristics and is well adapted to the shape of the hands of the user. The shown shape of the paddles 5 corresponds to the illustrative embodiment of the invention shown in the figures, but other embodiments of the paddles 5 are possible, e.g. in the form of transversal flat panels, transversal bars, etc.

As can be seen in images 1 and 2, the continuous moving track 2 with its front, higher part enters the housing 1 above which is mounted the wheel 4 with paddles 5. In the part of the housing 1 which is turned towards the moving track 2 in the field of view and within reach of the user who is located on the track 2 is mounted a control panel 6 with display. Inside the housing 1 is located the middle part of supporting structure of the fitness machine, the part of the device for changing the inclination of the track 2, such as the electromotor, and transmissions for activating the track 2 by turning of the wheel 4, the brake system 32 for adjusting resistance to turning of the wheel 4, and electronic equipment. The mentioned elements are located in the housing 1 and are completely sheltered by the housing 1 for safety and aesthetic reasons. The supporting structure can be in the shape of a latticed constuction of welded steel sections. The housing 1 can be performed of metal sheet, plastic, some other suitable material or combination of such materials.

Drawings 1 and 3 show the control panel 6 with display. With the help of the control panel 6 adjustments are made to the inclination of the continuous track 2, strength of resistance to turning the wheel 4 with paddles 5; duration of exercising, velocity of the track 2 and travelled distance of the track 2 are read and recorded. Control panel 6 with display is part of the electronic operational and recording system for the exercise machine according to the invention. All components of this system can be obtained on the market and are known to the expert in this technical field.

Figure 2:
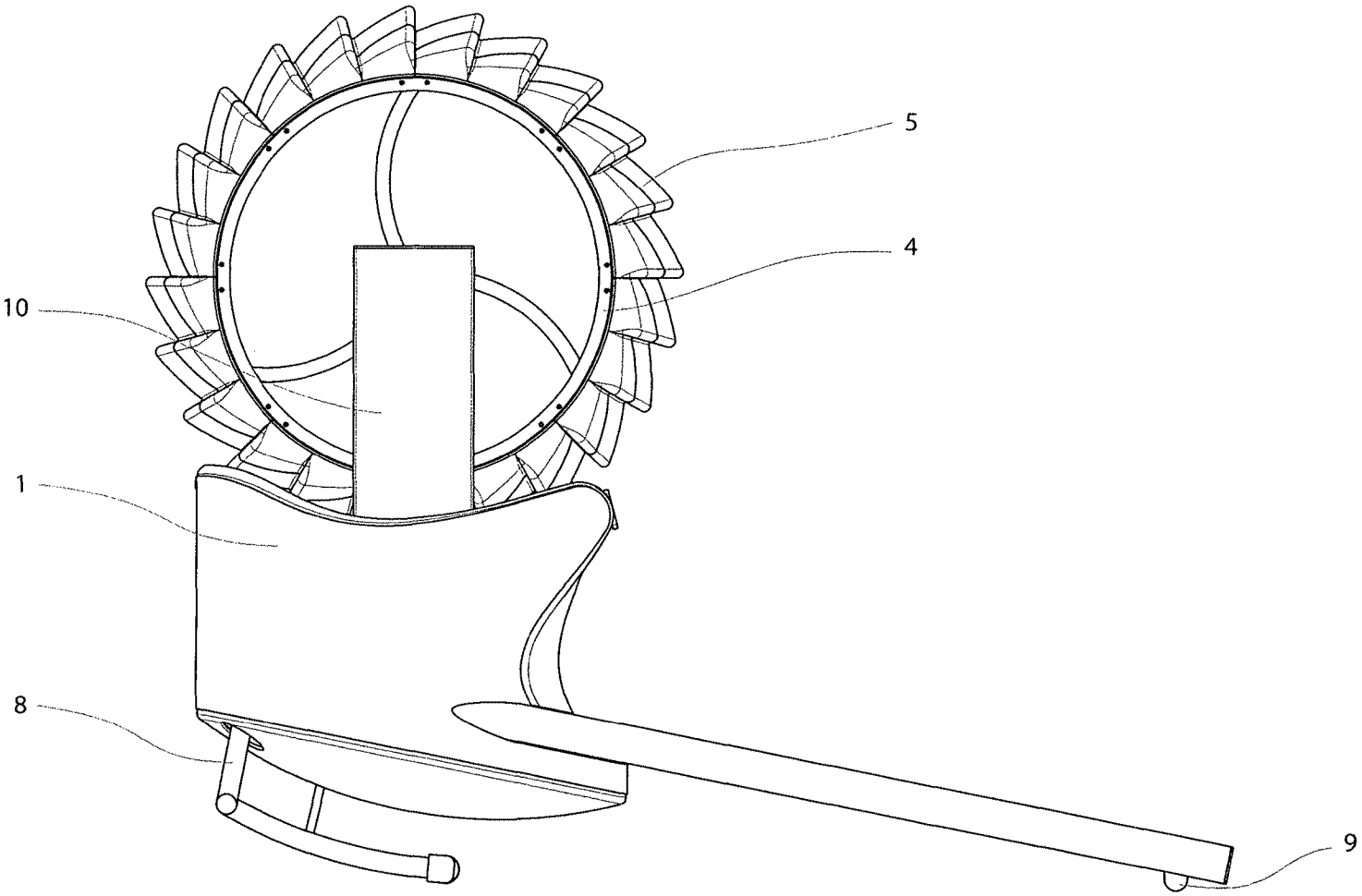
FIG. 2 depicts in side view the exercise machine with simulation of load rolling in accordance with the invention.
Figure 3:
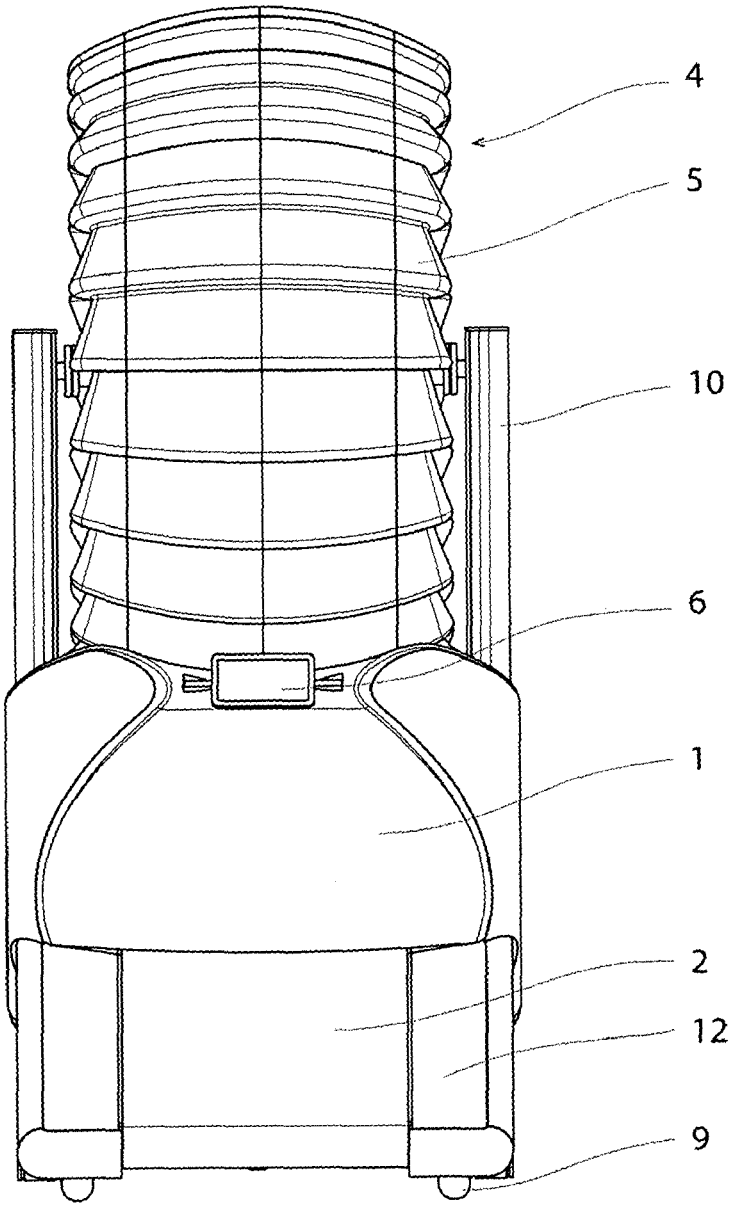
FIG. 3 depicts in frontal view the exercise machine with simulation of load rolling in accordance with the invention.
Figure 4:
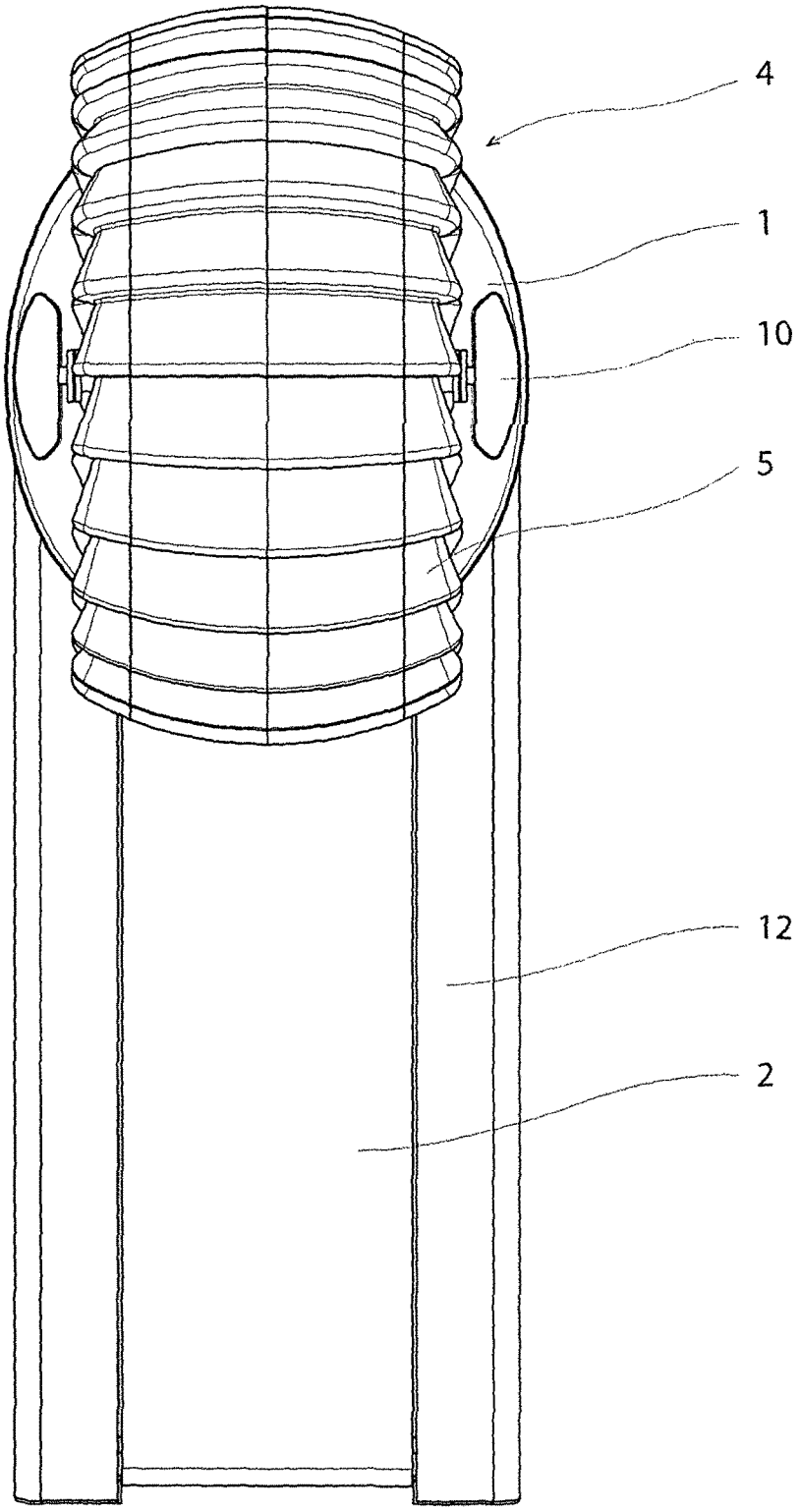
FIG. 4 depicts in plan or view from above the exercise machine with simulation of load rolling in accordance with the invention.
Figure 7:
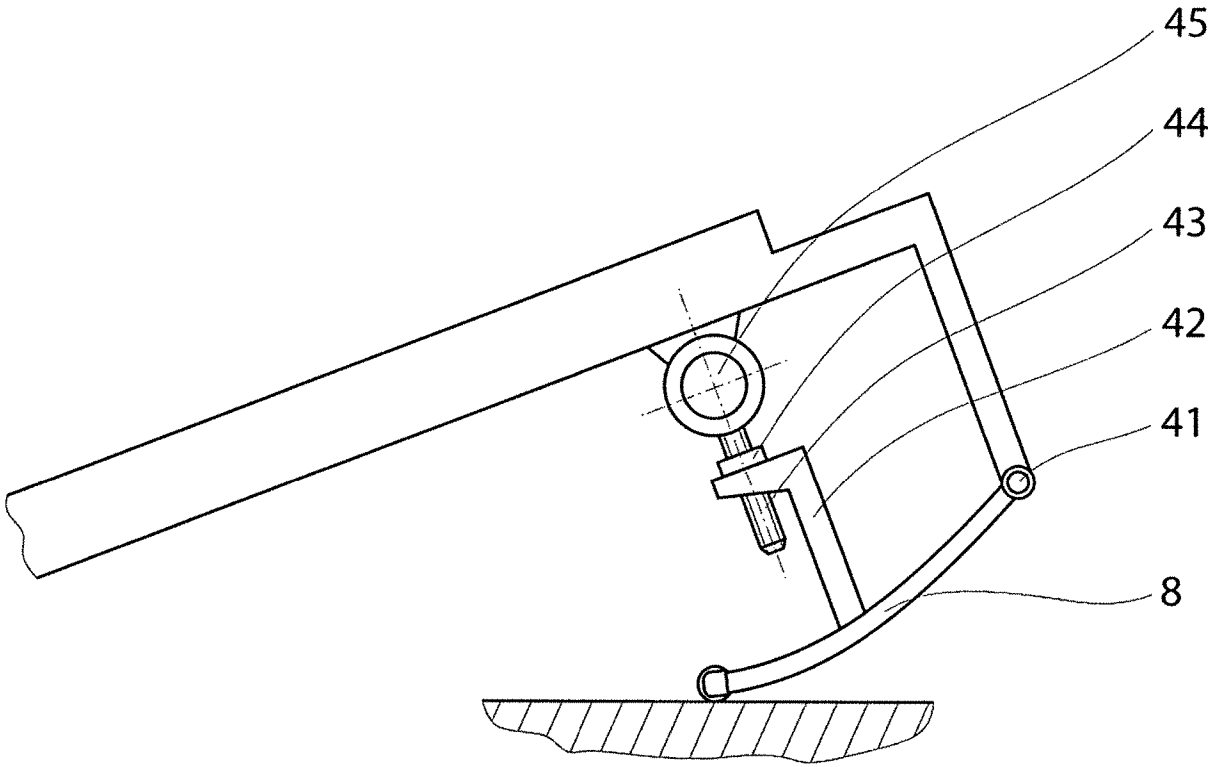
FIG. 7 depicts in a simplified manner in side view the device for adjustment of track inclination of the exercise machine with simulation of load rolling in accordance with the invention.

In FIG. 2 are shown the front leg 8 and the back leg 9 of the exercise machine according to the invention. The back legs 9 are mounted on the supporting structure in the area of the hind, accessible part of the continuous track 2. In the embodiments shown in the drawings the back stands 9 are performed as casters. The front stand 8 is performed as part of the device for adjusting the inclination of the continuous track 2 and in the depicted example of the embodiment it consists of bars rotated in respect of the supporting structure of the exercise machine and represents part of the device for adjusting the inclination of the track 2. The device for adjusting the inclination of the track 2 can be performed as a device with threaded connection driven by motor 45, preferably electromotor, as known in the state of the art, and it is connected to the control panel 6 with display. The front and back legs 8, 9 may have casters which facilitate relocation of the equipment inside the gym. One embodiment of the device for adjusting the inclination of the track 2 is shown in a simplified way in FIG. 7. The device for adjusting the inclination of the track 2 has a threaded spindle 43 and screw nut 44. The threaded spindle 43 is driven by motor 45 and their construction is connected with the supporting structure. During rotation of the threaded spindle 43, the screw nut 44 moves with a translatory motion along the threaded spindle 43, while the threaded spindle 43 and motor 45 maintain their position in respect of the structure carrying the track 2. Since the screw nut 44 is firmly connected with the holder 42 which is firmly connected with the front leg 8, the front leg 8, due to the motion of the screw nut 44, is turned around the joint 41 through which it is connected with the rest of the supporting structure. At the same time, the caster of the front leg 8 moves along the base increasing or decreasing the distance between the leg 8 and the supporting structure with track 2. Since the back leg 9 remains on the base, the track 2 increases or decreases its inclination in respect of the base.

Below is a brief description of the application of the exercise machine according to the invention. The user stands on the continuous moving track 2 and with the help of the command panel 6 with display chooses the incline of the track 2. By activating the motor 45 with the device for adjusting the incline, whose most important parts according to the illustrative embodiment are the indicated motor 45, threaded spindle 43, screw nut 44 and joint 41 whereby the front leg 8 is connected to the supporting structure, the incline of the continuous track 2 is changed and adjusted. Thereafter, through the control panel 6, with the help of the brake system 32 the resistance to turning the wheel 4 with paddles 5 is chosen. Once the exercise parameters have been chosen, the user pushes the paddles 5 by rolling the wheel 4 and through the mechanical transmission 20 activates the continuous track 2. As already stated, the mechanical transmission 20 may be comprised of two chain couplings and one gear coupling, where the first sprocket 23 of the chain coupling is on the shaft 11 of the wheel 4, and the last element of the transmission 20 i.e. the driven gear wheel 29 of the gear coupling is at one end of the upper, or drive cylinder 21 of the track 2. With simultaneous pushing of the paddles 5 the user is moving on the continuous moving track 2. During the training session, the user monitors the duration of the training session, velocity of the track 2 and travelled distance on the control panel 6, and has an overview of the chosen parameters of the training session. During the training session, the user can adjust the incline of the track 2 through the control panel 6 or change the force of resistance to turning of the wheel 4 by activating the brake system 32. In addition to this way of exercising, two additional ways of exercising on the machine with track 2 are available. The user can just walk or run on the horizontal or inclined track 2 without turning the wheel 4. During this kind of exercise when the track 2 is inclined, there is movement of the wheel 4 with paddles 5, even though the user is not turning the wheel 4 with his hands.

The next way of exercising on the machine according to the invention is turning the wheel 4 without moving on the track 2. The user stands on the lateral masks 12 of the track 2, whose surfaces are protected from slippage, and pushes the paddles 5 by hand. The track 2 is activated by the motion of the wheel 4. Because of the housing 1, the masks 10 of the supporting structure, and the masks 12 on the lateral sides of the moving track 2, the user is protected from injury. After completing the training session, the user turns the machine off via the control panel 6. The location inside the gym of the exercise machine according to the invention can easily be changed because of the casters on the legs 8, 9.

The described invention presents a modern and safe exercise machine with simulation of load pushing, which not only replaces exercising in the open air, but also, by application of high technology and electronics, enables adjustment of training parameters and monitoring of results. As can be seen in the illustrative embodiment, the exercise machine has exceptionally good ergonomic features and aesthetical qualities. Because of this, its use is not limited to sportists only, i.e. the machine can successfully be applied also in recreational and physical therapy. As stated for each part separately in the description, the parts of the exercise machine can be constructed by known technologies from available materials, and some of the parts are available on the market as finished products.

For realization of the machine according to the invention, constructions known in the state of the art were used, which are subject to numerous variations and modifications, as is obvious to the expert in the corresponding field. Also, certain elements of the invention are subject to modification, without exceeding the scope of claimed protection which is defined by the attached patent claims.

The invention claimed is:

1. Exercise machine with simulation of load pushing by hand, comprising:

a pair of cylinders including a front cylinder and a rear cylinder;

a base with lateral masks;

a continuous moving track mounted on the pair of cylinders, of adjustable incline in respect to the base;

a housing, where a front end of the continuous moving track is fitted into the housing;

a control panel with display affixed to the housing;

a transmission;

a brake system operated through the control panel;

wherein the front cylinder is connected by the transmission to the brake system;

a support structure of the exercise machine, the support structure including a plurality of supports, wherein the supports are placed at an approximately right angle in respect of the continuous moving track;

a wheel with a shaft pivotally mounted to the plurality of supports, the wheel including a ring and a plurality of spokes coupling the shaft to the ring;

paddles circumferentially disposed about an outer surface of the ring of the wheel, where the wheel with the paddles is located in front of the continuous moving track and above the housing, wherein the paddles are configured to be pushed by hands of a user; and a mechanical transmission connecting the wheel with the continuous moving track such that the continuous moving track and the wheel rotate in opposite directions.

2. Exercise machine with simulation of load pushing by hand according to claim 1, wherein the paddles on the outer surface of the ring of the wheel are formed in the shape of teeth, where the cross section of one tooth is a three sided geometrical image with curvilinear sides and at least one rounded vertex.

3. Exercise machine with simulation of load pushing hand according to claim 1, wherein the paddles on the outer surface of the ring of the wheel are formed in the shape of transversal flat panels or transversal ribs or transversal bars.

4. Exercise machine with simulation of load pushing hand according to claim 1, wherein the brake system is used for changing a resistance to turning the wheel, wherein the brake system includes a mechanical brake system, magnetic brake system or electromagnetic brake system.

5. Exercise machine with simulation of load pushing by hand according to claim 1, further comprising a motor, wherein the control panel with display is connected by electronic components to the motor for changing an inclination of the track and to the brake system for changing a resistance to turning the wheel, and wherein the control panel with display includes commands for adjusting and monitoring the inclination of the moving track and the resistance to turning of the wheel with the paddles and monitoring a duration of the training session and travelled distance on the continuous moving track.

6. Exercise machine with simulation of load pushing by hand according to claim 1, wherein in the housing is located a drive motor for adjusting an inclination of the track in respect of the base.

7. Exercise machine with simulation of load pushing by hand according to claim 1, further comprising legs, wherein the legs have mounted casters for relocation of the exercise machine.

8. Exercise machine with simulation of load pushing by hand according to claim 1, wherein the transmission includes a pulley.

9. Exercise machine with simulation of load pushing by hand according to claim 1, wherein the mechanical transmission includes a combined chain gear transmission.

* * * * *